US005315090A

United States Patent [19]

Lowenthal

[11] Patent Number: 5,315,090

[45] Date of Patent: May 24, 1994

[54] AWNING GUTTER

[76] Inventor: John D. Lowenthal, 91-28 96 St., Woodhaven, N.Y. 11421

[21] Appl. No.: 48,308

[22] Filed: Apr. 19, 1993

[51] Int. Cl.[5] ..... H05B 1/00; E04D 13/00

[52] U.S. Cl. ..... 219/213; 52/11; 52/16; 239/208; 405/119; 405/121

[58] Field of Search ..... 219/213; 248/48.1, 48.2; 405/118, 119, 120, 121; 52/11, 12, 15, 16; 239/208

[56] References Cited

U.S. PATENT DOCUMENTS

| | | | |
|---|---|---|---|
| 2,419,996 | 5/1947 | Honikman | 405/119 |
| 3,233,078 | 2/1966 | Siemianowski | 219/213 |
| 3,612,453 | 10/1971 | Zimmer | 248/48.2 |
| 3,821,512 | 6/1974 | Stanford | 219/213 |
| 3,904,121 | 9/1975 | Geagan | 239/208 |
| 4,134,002 | 1/1979 | Stanford | 219/213 |
| 4,142,370 | 3/1979 | Giordano | 405/119 |
| 4,313,693 | 2/1982 | Follows et al. | 405/121 |
| 4,619,554 | 10/1986 | Walker et al. | 405/120 |
| 4,726,151 | 2/1988 | Vitale | 52/16 |
| 4,951,430 | 8/1990 | Gottlieb | 248/48.2 |
| 5,046,692 | 9/1991 | Nicholas | 248/48.2 |
| 5,220,755 | 6/1993 | Roles | 239/208 |

FOREIGN PATENT DOCUMENTS

| | | | |
|---|---|---|---|
| 62483 | 10/1982 | European Pat. Off. | 52/11 |
| 1924139 | 11/1970 | Fed. Rep. of Germany | 405/121 |
| 2-248566 | 10/1990 | Japan | 52/11 |
| 207009 | 11/1923 | United Kingdom | 405/121 |

*Primary Examiner*—Geoffrey S. Evans
*Attorney, Agent, or Firm*—Leon Gilden

[57] ABSTRACT

An elongate channel member is arranged for mounting to a front wall of an awning to direct rainwater therefrom. The channel is arranged to include spaced lug members, having support apertures to each receive a fastener for securement of the channel to the awning member.

1 Claim, 4 Drawing Sheets

FIG. 5
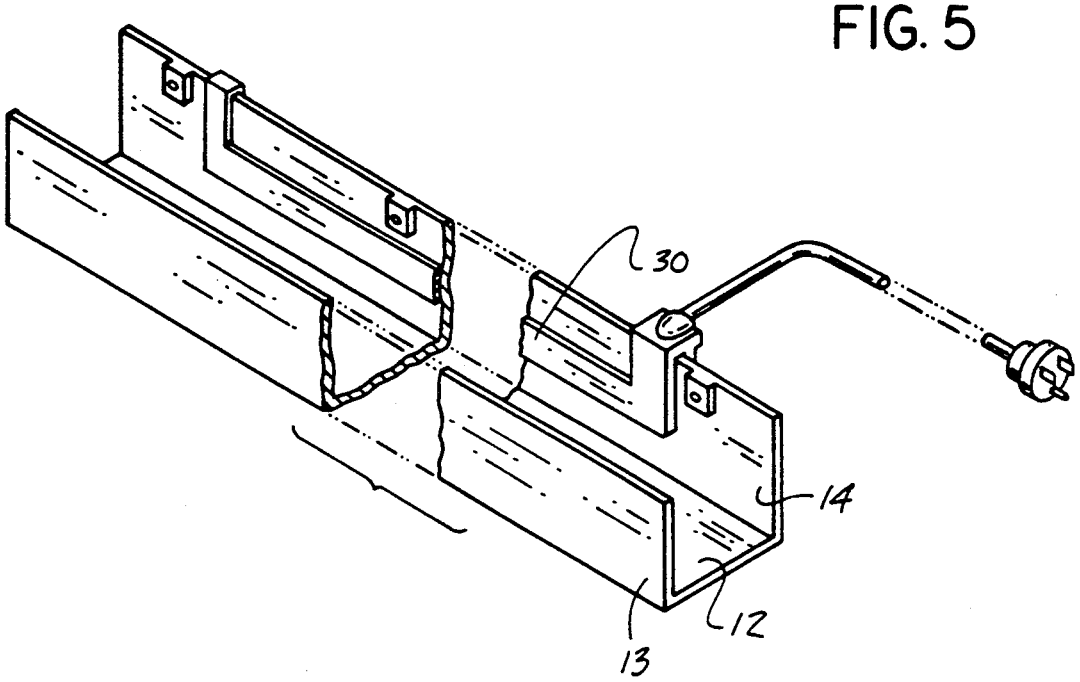
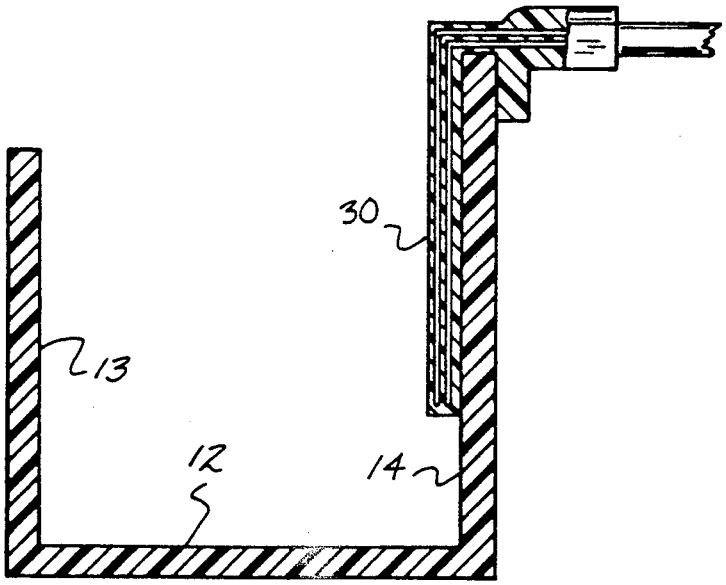
FIG. 6

AWNING GUTTER

BACKGROUND OF THE INVENTION

1. Field of the Invention

The field of invention relates to gutter structure, and more particularly pertains to a new and improved awning gutter wherein the same is arranged for retrofit to an existing awning member.

2. Description of the Prior Art

Various awning structure such as aluminum awnings are positioned relative to portals and windows and the like of various buildings. Particularly relative to the entrance ways of such buildings, the fluid directed thereon is undesirable relative to erosion as well as during wintry climatic conditions and fluid directed onto such entrance ways is subject to freezing resulting in hazardous conditions. The instant invention is arranged to overcome deficiencies of the prior art by providing for a retrofit awning gutter structure arranged for securement relative to an awning member and in this respect, the present invention substantially fulfills this need.

SUMMARY OF THE INVENTION

In view of the foregoing disadvantages inherent in the known types of gutter apparatus now present in the prior art, the present invention provides an awning gutter wherein the same is arranged for securement relative to a front wall of the awning member. As such, the general purpose of the present invention, which will be described subsequently in greater detail, is to provide a new and improved awning gutter which has all the advantages of the prior art awning gutters and none of the disadvantages.

To attain this, the present invention provides an elongate channel member arranged for mounting to a front wall of an awning to direct rainwater therefrom. The channel is arranged to include spaced lug members, having support apertures to each receive a fastener for securement of the channel to the awning member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved awning gutter which has all the advantages of the prior art awning gutters and none of the disadvantages.

It is another object of the present invention to provide a new and improved awning gutter which may be easily and efficiently manufactured and marketed.

It is a further object of the present invention to provide a new and improved awning gutter which is of a durable and reliable construction.

An even further object of the present invention is to provide a new and improved awning gutter which is susceptible of a low cost of manufacture with regard to both materials and labor, and which accordingly is then susceptible of low prices of sale to the consuming public, thereby making such awning gutter economically available to the buying public.

Still yet another object of the present invention is to provide a new and improved awning gutter which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of the invention including a heating member mounted to the second wall structure.

FIG. 6 is an orthographic side view of the invention, as indicated in FIG. 5.

DESCRIPTION OF THE PREFERRED EMBODIMENT

Figure 1:
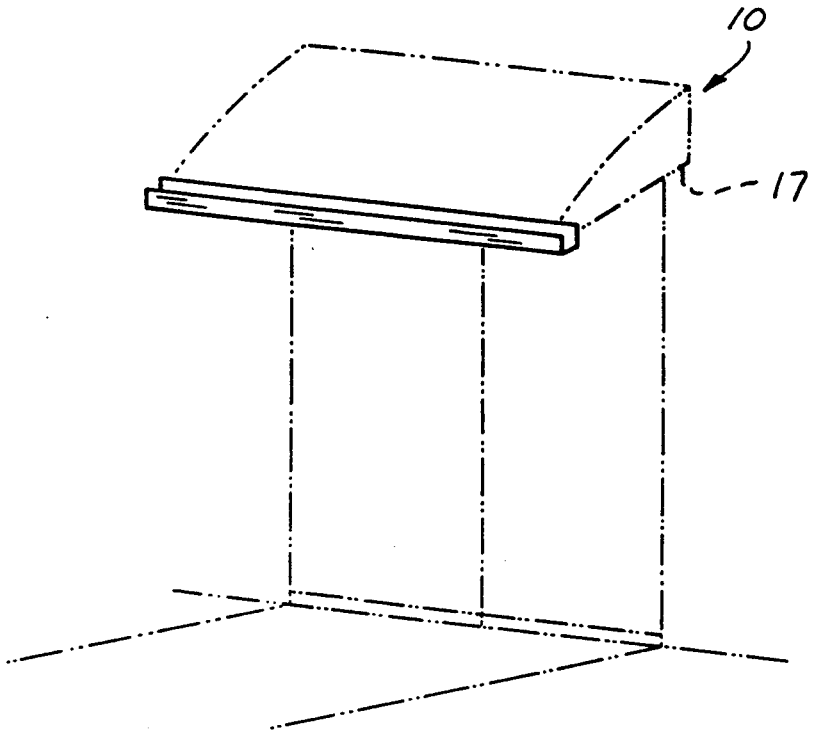
FIG. 1 is an isometric illustration of the invention in use.
Figure 2:
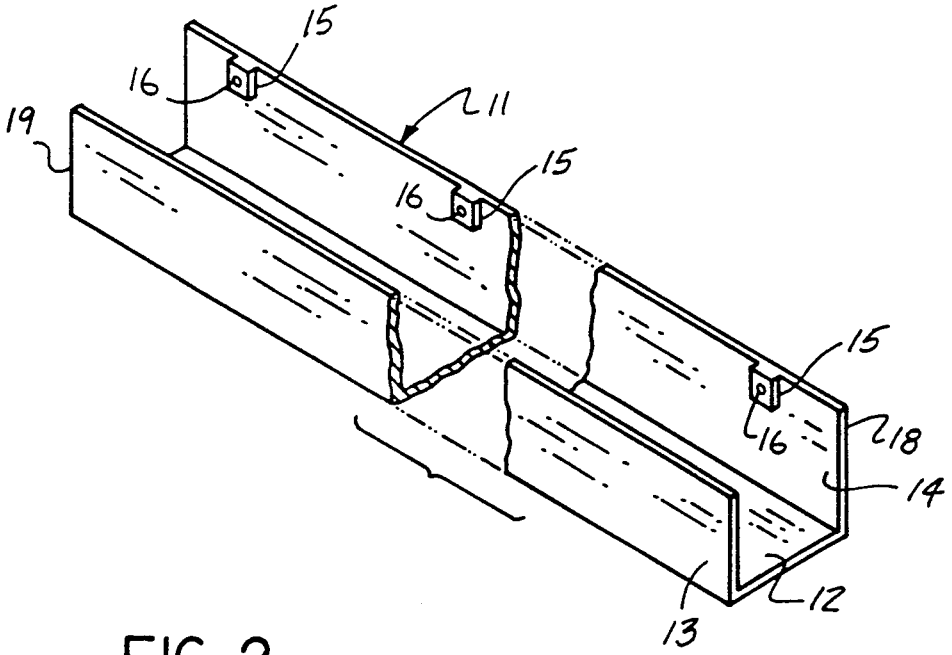
FIG. 2 is an enlarged isometric illustration of the invention.
Figure 3:
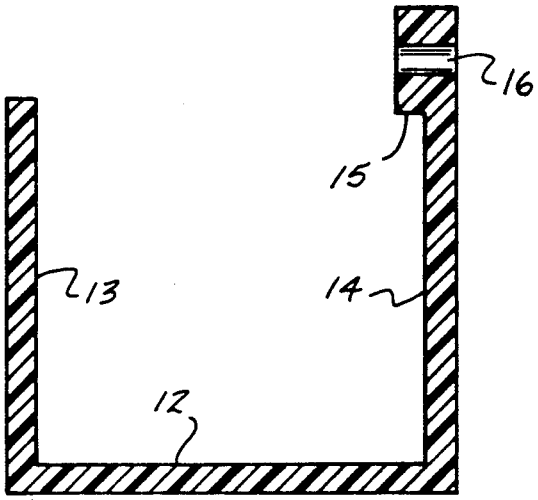
FIG. 3 is an orthographic cross-sectional illustration of the gutter structure.

With reference now to the drawings, and in particular to FIGS. 1 to 8 thereof, a new and improved awning gutter embodying the principles and concepts of the present invention and generally designated by the reference numeral 10 will be described.

More specifically, the awning gutter 10, as indicated in FIG. 1, essentially comprise an elongated channel 111 having a bottom wall 11, with a first side wall 12 of a first height fixedly mounted to the bottom wall 11, with a second side wall 13 having a second height greater than the first height mounted to the bottom wall 11 in a spaced coextensive relationship relative to the first side wall 12. The elongate channel includes respective channel first and second ends 18 and 19, with the second side wall 13 having spaced lug members 15 integrally mounted thereto at an upper free edge of the second side wall, with each of the lug members 15 including a support aperture 16 directed therethrough, with each support aperture arranged in a parallel relationship relative to the bottom wall 11. In this manner, various fasteners (not shown) may be directed through the apertures 16 for securement to the awning 17 at a front wall of the awning to direct rainwater therefrom.

Figure 4:
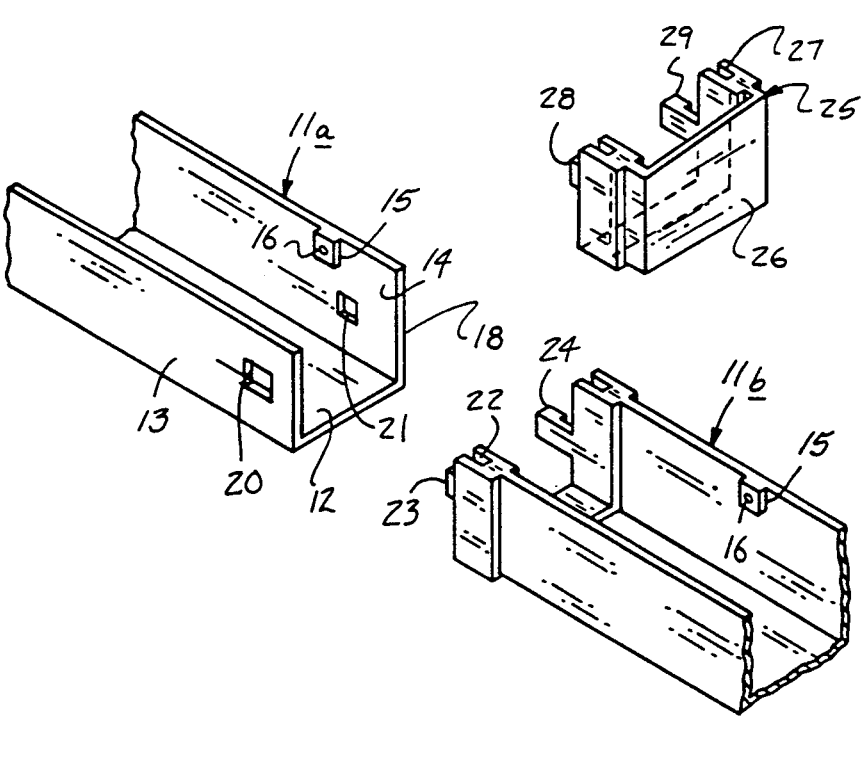
FIG. 4 is an isometric illustration of a modified interfitting gutter structure of the invention.

The reference to the FIG. 4 indicates the use of a modified channel 11*a* having respective first and second latch openings 20 and 21 directed through the respective first and second side walls 12 and 13 respectively at an equal distant spacing relative to the bottom wall 11. An extension gutter 11*b* accordingly is provided, having a U-shaped channel 22 mounted at an end thereof to complementarily receive the channel first end 18 of the bottom wall 11 and first and second side walls 12 and 13. Respective first and second L-shaped resilient latch legs 23 and 24 extend from the first and second side walls 12 and 13 of the extension gutter 11*b* to be received within respective first and second latch openings 20 and 21. Optionally, an end cap 25 is arranged for mounting to the respective first and second ends, wherein the end cap 25 includes an end wall plate 26, with a U-shaped channel 27 extending from the end plate 26 arranged to receive either the first or second ends 18 or 19 of the elongate channel structure 11*a*. End cap first and second resilient latch legs 28 and 29 are accordingly arranged for reception within the latch openings 20 and 21.

The FIG. 6 for example exemplifies the use of a heating grid 30 mounted onto the second side wall 13 in a facing relationship relative to the first side wall 12, whereupon ice accumulation within the channel structure may be melted for directing such fluid from the channel.

Figure 7:
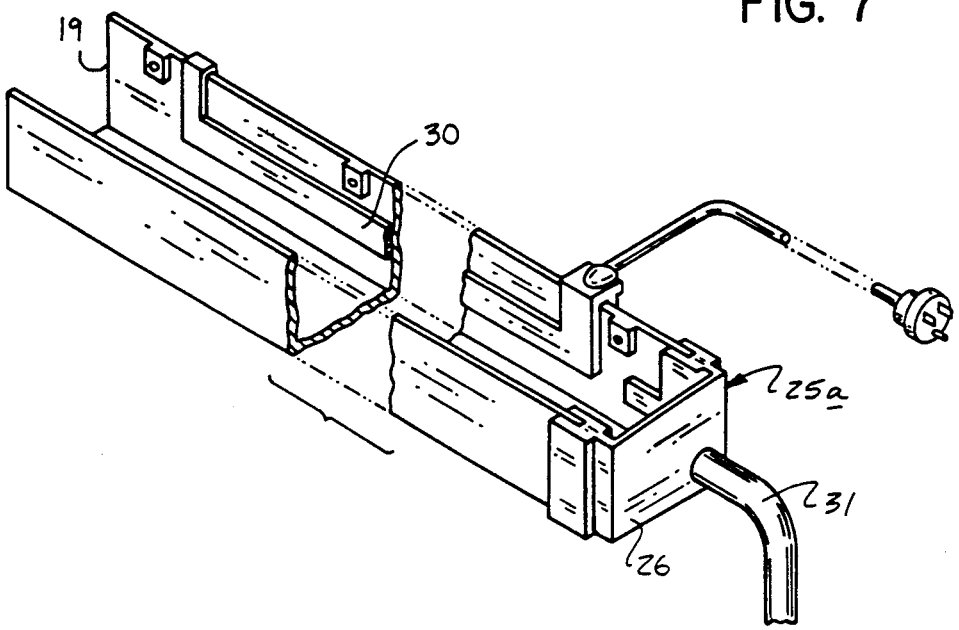
FIG. 7 is an isometric illustration of the invention including a drainage tube.
Figure 8:
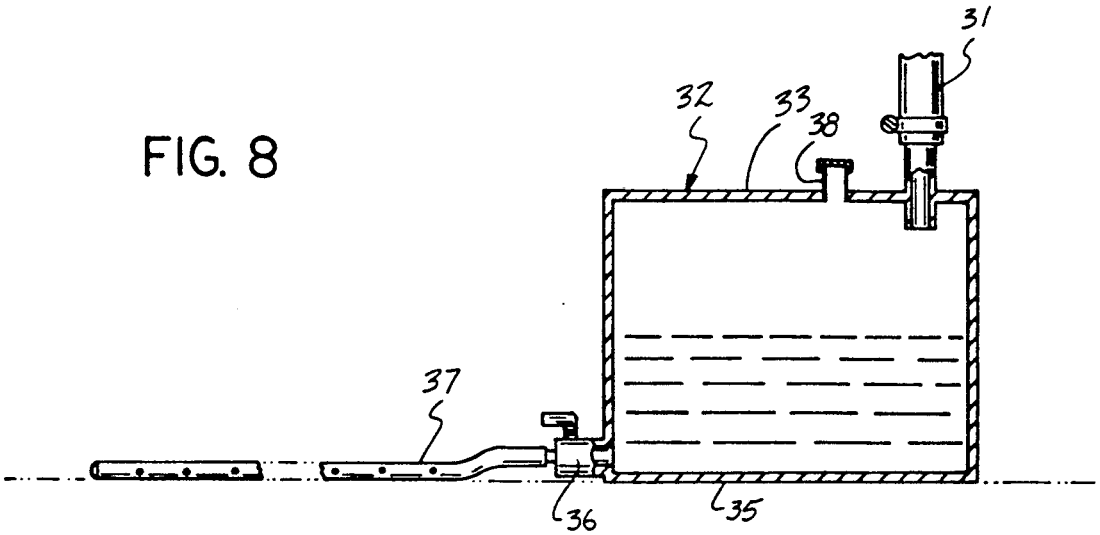
FIG. 8 is an orthographic cross-sectional illustration of a reservoir housing arranged for fluid communication to the drainage tube of FIG. 7.

Reference to the FIGS. 7 and 8 indicates the use of a drain tube 31 mounted to a modified end cap 25*a*, and more specifically to the end wall plate 26. The drain tube 31 is directed to an underlying reservoir housing 32 (see FIG. 8), with the reservoir housing 32 including a housing top wall 33 spaced from a housing side wall 34, having a housing floor 35. A valve 36 is mounted in adjacency to the housing floor 35 in fluid communication with an apertured flexible tube 37 to permit the use of such captured rainwater for irrigation purposes for its reclamation and reuse. Further, an overflow tube 38 is mounted to the housing top wall 33 to permit overflow of water from within the reservoir should the valve 36 be closed and excess rainwater captured within the reservoir housing 32 in excess of the housing capacity for such storage.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An awning gutter arranged for securement to an awning member, wherein the awning gutter comprises, an elongate channel, the elongate channel having a bottom wall, a first side wall, and a second side wall, wherein the first side wall and the second side wall are arranged in a coextensive spaced relationship, with the elongate channel having a channel first end spaced from a channel second end, the first side wall having a first height, and second side wall having a second height greater than said first height, with the second side wall having an uppermost end spaced from the bottom wall, wherein the uppermost end extends beyond the first side wall and above the first side wall, and includes a plurality of spaced lug members integral therewith, each of the lug members includes a support aperture, each support apertures is arranged for reception of a fastener therethrough for securement to said awning, and an extension channel, the extension channel including an extension channel first end and the extension channel first end having a U-shaped channel, with the U-shaped channel arranged for receiving the elongate channel first end, and the elongate channel first end including a first latch opening directed through the first side wall and the second latch opening directed through the second side wall, with the extension channel having a first L-shaped resilient latch leg extending beyond the first side wall and the U-shaped channel, and a second L-shaped resilient latch leg parallel to said first L-shaped resilient latch leg extending beyond the second side wall, with the first L-shaped resilient latch leg arranged for reception within the first latch opening, and the second L-shaped resilient latch leg is arranged for reception within the second latch opening, and including an end cap, the end cap arranged for selective securement to the elongate channel first end, with the end cap having an end cap U-shaped channel arranged for receiving the elongate channel first end therein, wherein the end cap includes an end wall plate orthogonally oriented relative to said channel bottom wall, the channel first side wall, and the channel second side wall, with the end cap including an end cap first resilient latch leg arranged for reception within the first latch opening, and an end cap second resilient latch leg arranged for reception within the second latch opening, and a heating grid mounted to the second side wall in facing relationship to the first side wall, with the heating grid arranged for the melting of frozen fluid contained within said channel, and the end wall plate includes a drain tube directed therefrom in fluid communication with said elongate channel, with a reservoir housing having a housing top wall, a housing side wall, and a housing floor, with the drain tube directed into the reservoir housing through the housing top wall, and a valve mounted to the housing side wall in adjacency to the housing floor, and apertured flexible tube in fluid communication with the reservoir housing through the valve and the housing side wall, and an overflow tube projected into the reservoir housing through the top wall.

* * * * *